US011504976B2

(12) United States Patent
Ishikawa et al.

(10) Patent No.: US 11,504,976 B2
(45) Date of Patent: Nov. 22, 2022

(54) MOBILE PRINTER

(71) Applicant: TOSHIBA TEC KABUSHIKI KAISHA, Tokyo (JP)

(72) Inventors: Daisuke Ishikawa, Mishima Shizuoka (JP); Kazuki Taira, Ota Tokyo (JP); Takaya Kitawaki, Mishima Shizuoka (JP); Daisuke Harayama, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/239,203

(22) Filed: Apr. 23, 2021

(65) Prior Publication Data

US 2022/0072868 A1 Mar. 10, 2022

(30) Foreign Application Priority Data

Sep. 7, 2020 (JP) ..... JP2020-149666

(51) Int. Cl.
*B41J 2/21* (2006.01)
*B41J 3/36* (2006.01)

(52) U.S. Cl.
CPC .. *B41J 2/21* (2013.01); *B41J 3/36* (2013.01)

(58) Field of Classification Search
CPC ..... B41J 2/21; B41J 3/36
See application file for complete search history.

(56) References Cited

U.S. PATENT DOCUMENTS

2002/0136581 A1* 9/2002 Arledge ..... B42F 7/14 400/120.01
2002/0158955 A1 10/2002 Hess et al.
2012/0044278 A1 2/2012 Hwang et al.
2013/0271547 A1 10/2013 Umetsu
(Continued)

FOREIGN PATENT DOCUMENTS

CN 105538970 A 5/2016
EP 3 007 011 A1 4/2016
EP 3 112 182 A1 1/2017
(Continued)

OTHER PUBLICATIONS

Extended European Search Report dated Nov. 22, 2021 issued in EP Application No. 21178291.7, 10 pages.
(Continued)

*Primary Examiner* — Justin Seo
(74) *Attorney, Agent, or Firm* — Foley & Lardner LLP

(57) ABSTRACT

According to at least one embodiment, a mobile printer includes a casing, a sensor, a print head, an interface, a controller, and a decolorizing device. The casing includes a power supply. The sensor detects the movement of the casing. The print head discharges ink containing a thermochromic colorant. The interface acquires image data. The controller discharges the ink from the print head based on the image data acquired by the interface and the movement of the casing detected by the sensor. The decolorizing device is coupled to the casing and includes a translucent film in which heat is generated by an applied voltage and a translucent substrate that is heated to a temperature at which the thermochromic colorant is decolorized by the heat generated in the translucent film.

20 Claims, 7 Drawing Sheets

(56) References Cited

U.S. PATENT DOCUMENTS

| | | | |
|---|---|---|---|
| 2014/0150203 | A1 | 6/2014 | Banzai et al. |
| 2017/0274699 | A1 | 9/2017 | Schwendimann et al. |

FOREIGN PATENT DOCUMENTS

| | | | |
|---|---|---|---|
| EP | 3 418 062 | A1 | 12/2018 |
| EP | 3 620 305 | A1 | 3/2020 |
| JP | H08-320463 | A | 12/1996 |
| JP | 2005-014575 | A | 1/2005 |
| JP | 2012-035612 | A | 2/2012 |
| JP | 2014-177053 | A | 9/2014 |
| JP | 2015-101087 | A | 6/2015 |
| JP | 2015-150889 | A | 8/2015 |
| JP | 2019-126917 | A | 8/2019 |

OTHER PUBLICATIONS

Extended European Search Report dated Nov. 22, 2021 issued in EP Application No. 21178322.0, 8 pages.

* cited by examiner

MOBILE PRINTER

CROSS-REFERENCE TO RELATED APPLICATION

This application is based upon and claims the benefit of priority from Japanese Patent Application No. 2020-149666, filed on Sep. 7, 2020, the entire contents of which are incorporated herein by reference.

FIELD

At least one embodiment described herein relates generally to a mobile printer.

BACKGROUND

In a related art, there is a printer that forms an image on a recording medium with ink containing a thermochromic colorant. The thermochromic colorant changes color by being heated to a predetermined temperature or higher. For example, an image formed by a printer on a recording medium with ink containing a thermochromic colorant is decolorized by a decolorizing apparatus. As the decolorizing apparatus, there is an apparatus that decolorizes the thermochromic colorant on the recording medium by heating the entire recording medium. The decolorizing apparatus that heats the entire recording medium has a problem of not being able to selectively decolorize only a region designated by a user.

There is a decolorizing instrument that decolorizes the thermochromic colorant by frictional heat generated by rubbing the recording medium with a dedicated member such as rubber provided at a rear end of a pen or an end of a cap for the pen. Such a decolorizing instrument has a problem that accurately checking a position where the decolorizing instrument decolorizes is not easy.

The user of the mobile printer may want to decolorize the thermochromic colorant on the recording medium before printing. In order to decolorize the thermochromic colorant on the recording medium before printing, a mobile printer provided with a decolorizing device is required. As the decolorizing device provided in the mobile printer, a device that can decolorize the thermochromic colorant while the user can accurately check the position on the recording medium is desired.

DETAILED DESCRIPTION

At least one embodiment provides a mobile printer including a device that allows a user to easily check the location to be decolorized.

In general, according to at least one embodiment, there is provided a mobile printer including a casing, a sensor, a print head, an interface, a controller, and a decolorizing device. The casing includes a power supply. The sensor detects the movement of the casing. The print head discharges ink containing a thermochromic colorant. The interface acquires image data. The controller causes the ink to be discharged from the print head based on the image data acquired by the interface and the movement of the casing detected by the sensor. The decolorizing device is attached to the casing and includes a translucent film in which heat is generated by an applied voltage and a translucent substrate that is heated to a temperature at which the thermochromic colorant is decolorized by the heat generated in the translucent film. As utilized herein, the term "translucent" describes an ability to permit passage of light, such as without appreciable scattering. As utilized herein, a "translucent" body is one through which light may pass. For example, light may pass through a "translucent" body without appreciable scattering so that bodies lying beyond the body are seen clearly. As utilized herein, the term "translucent" includes the term "transparent." Thus, a body that is described herein as being "translucent" may be "transparent."

Hereinafter, at least one embodiment will be described with reference to the accompanying drawings.

A mobile printer according to at least one embodiment includes a decolorizing device that decolorizes a thermochromic colorant. In at least one embodiment, as an example of the mobile printer including a decolorizing device, a mobile printer including a decolorizing device for decolorizing the thermochromic colorant on a recording medium will be described. In at least one embodiment, decoloration refers to applying heat to the thermochromic colorant to change a color thereof from a color that is visible to humans to a translucent color that is not visible to humans.

First, a configuration of the mobile printer according to at least one embodiment will be described.

Figure 1:
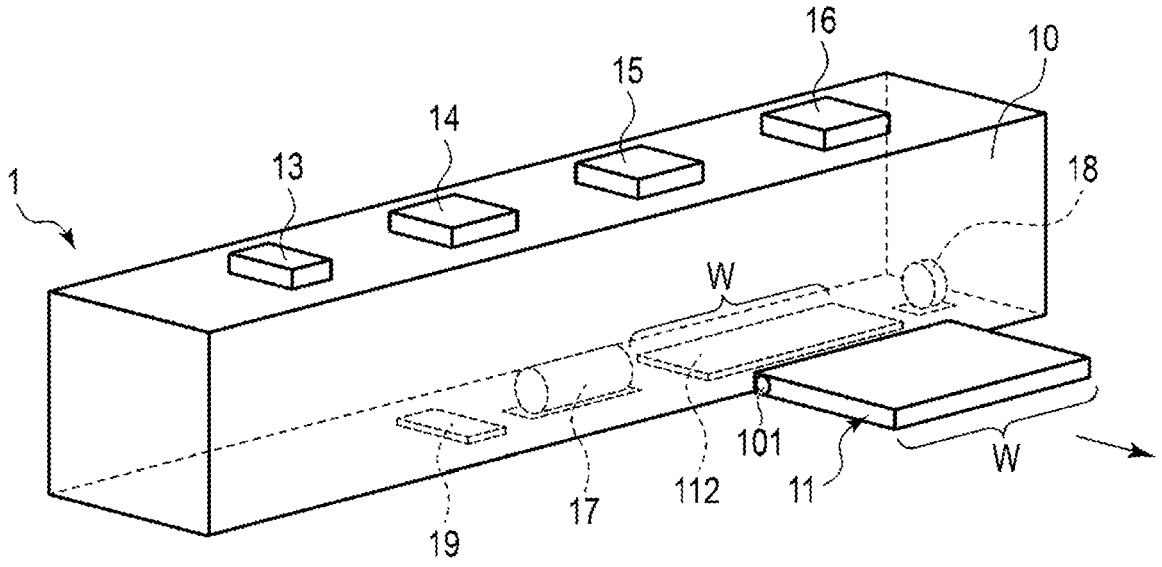
FIG. 1 is an external view illustrating a first configuration example of a mobile printer according to at least one embodiment.
Figure 2:
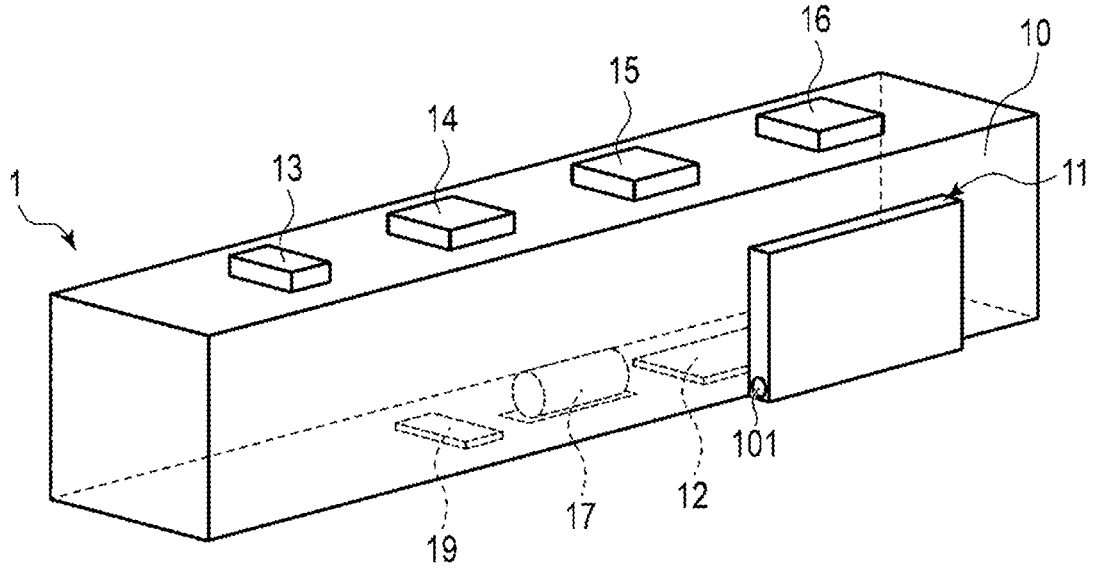
FIG. 2 is another external view illustrating the first configuration example of the mobile printer.

FIGS. 1 and 2 are external views illustrating a first configuration example of a mobile printer 1 according to at least one embodiment.

In the configuration examples illustrated in FIGS. 1 and 2, the mobile printer 1 includes a casing 10, a decolorizing device (translucent heater) 11, a print head 12, a power button 13, a temperature switching button 14, a heating button 15, and a print button 16, rollers 17 and 18, and a sensor 19.

The decolorizing device 11 is a translucent device that decolorizes the thermochromic colorant. The decolorizing device 11 is configured so that the top of the recording medium can be seen through when pressed against the recording medium. That is, the decolorizing device 11 is configured so that the user can directly see the portion pressed for decolorizing the thermochromic colorant. The decolorizing device 11 includes, for example, a translucent substrate 21 (e.g., see FIGS. 5 and 6) that is heated by heat from a translucent heat source. The translucent substrate 21 of the decolorizing device 11 reaches a temperature (e.g., decolorizing temperature) at which the thermochromic colorant is decolorized by heat from a heat source. When a front surface (e.g., decolorizing surface) of the translucent substrate 21 that reaches the decolorizing temperature is pressed against the recording medium, the thermochromic colorant on the recording medium decolorizes.

The casing 10 is a casing to which each part such as the decolorizing device 11, the power button 13, the temperature switching button 14, and the heating button 15 is attached. The print head 12, the rollers 17 and 18, and the sensor 19 are provided in the casing 10. A controller 30 (e.g., see FIG. 7) and a battery 40 (see FIG. 7) are also provided in the casing 10.

The casing 10 is a handle that the user grips. The user moves the bottom surface of the gripped casing 10 on the recording medium. The mobile printer 1 decolorizes the thermochromic colorant on the recording medium or forms an image on the recording medium by moving (scanning) the casing 10 on the recording medium by the user.

The casing 10 is provided with a support mechanism 101 that holds the decolorizing device 11 in a decolorizing position or an accommodating position. FIG. 1 illustrates a state in which the decolorizing device 11 is in the decolorizing position. FIG. 2 illustrates a state in which the decolorizing device 11 is in the accommodating position. In the configuration examples illustrated in FIGS. 1 and 2, the decolorizing device 11 rotates with respect to the casing 10 about a fulcrum of the support mechanism 101.

The support mechanism 101 includes a lock mechanism that locks the decolorizing device 11 at the decolorizing position or the accommodating position. The lock mechanism included in the support mechanism 101 may be any lock mechanism that can be locked or unlocked by user operation. For example, the decolorizing device 11 locked at the decolorizing position is unlocked and moved to the accommodating position by the user moving the casing 10 so as to be folded with respect to the casing 10. The decolorizing device locked at the accommodating position is unlocked and moved to the decolorizing position by an operation of the user.

At the decolorizing position illustrated in FIG. 1, the decolorizing device 11 is fixed at a position where the decolorizing surface pressed against the recording medium is on the same surface as the bottom surface of the casing 10. When the bottom surface of the casing 10 is moved while being abutted on the recording medium, the decolorizing surface of the decolorizing device 11 also moves on the recording medium. The decolorizing device 11 is configured with a translucent device. For that reason, the user can directly visually recognize the position (decolorizing position) where the decolorizing surface of the decolorizing device 11 abuts on. As a result, the user can move the decolorizing surface which is on the same surface as the bottom surface of the casing 10 by pressing the decolorizing surface against the recording medium while checking the decolorizing position.

In the accommodating position illustrated in FIG. 2, the decolorizing device 11 is held in an accommodating position where the decolorizing surface is parallel to a side surface of the casing 10. When the decolorizing device 11 is accommodated in the accommodating position, the mobile printer 1 can reduce a bottom area (area of a bottom surface including the bottom surface of the casing 10 and the decolorizing surface of the decolorizing device 11). By holding the decolorizing device 11 in the accommodating position, the decolorizing device 11 can be prevented from becoming bulky, and the mobile printer 1 can be easily carried around.

The mobile printer 1 is configured so that power can be supplied to the decolorizing device 11 located at the decolorizing position and power cannot be supplied to the decolorizing device 11 located at the accommodating position. The decolorizing device 11 is electrically connected to the controller 30 (see FIG. 7) or the like in the casing 10, at the decolorizing position as illustrated in FIG. 1. The electrical connection of the decolorizing device 11 with the controller 30 (see FIG. 7) or the like in the casing 10 is disconnected at the accommodating position as illustrated in FIG. 2. With this configuration, in the mobile printer 1, power is not supplied to the decolorizing device 11 located at the accommodating position, and the printer 1 can be safely carried and stored.

The support mechanism 101 is not limited to a mechanism that rotates the decolorizing device 11 with respect to the casing 10. The support mechanism 101 may be any mechanism as long as the mechanism can hold the decolorizing device 11 at the decolorizing position and the accommodating position. For example, the support mechanism 101 may be a mechanism that slides the decolorizing device 11 to be accommodated in the accommodating position in the casing 10. The support mechanism 101 may be a mechanism capable of removing the decolorizing device 11.

The print head 12 forms an image on the recording medium. For example, the print head 12 is an inkjet head. In at least one embodiment, the print head 12 discharges ink made of a thermochromic colorant. However, the print head 12 may selectively discharge the ink of the thermochromic colorant and other inks. The print head 12 is attached to the casing 10 so as to discharge ink onto the recording medium from the bottom surface of the casing 10.

The print head 12 is configured to print a plurality of pixels in the main scanning direction. A width (e.g., print width) to be printed by the print head 12 in the main scanning direction and a width (e.g., decolorizing width) to be decolorized by the decolorizing device 11 in the main scanning direction are formed to be the same width.

In the configuration example illustrated in FIG. 1, the decolorizing device 11 is disposed so as to be upstream of the print head 12 in the sub-scanning direction. When the casing 10 moves in the sub-scanning direction, the decolorizing width W of the decolorizing device 11 is formed to be the same as the print width W of the print head 12. In the mobile printer 1 illustrated in FIG. 1, when the casing 10 is moved in the sub-scanning direction, the print head 12 can print an image in a region that has been decolorized by the decolorizing device 11.

The decolorizing device 11 may be provided on both sides of the casing 10 so as to sandwich the print head 12. For example, in the example illustrated in FIG. 1, another decolorizing device having the same decolorizing width as the print width W may be provided on a side surface opposite to the side surface of the casing 10 to which the decolorizing device 11 is attached. When two decolorizing devices are provided so as to sandwich the print head 12, control may be made such that any decolorizing device can be used according to the moving direction of the casing 10.

The rollers 17 and 18 are provided on the bottom surface of the casing 10. The rollers 17 and 18 rotate in a direction (e.g., sub-scanning direction) perpendicular to the main scanning direction of the print head 12. The rollers 17 and 18 regulate the moving direction of the casing 10 to the sub-scanning direction when the bottom surface of the casing 10 moves to the recording medium.

The sensor 19 detects the movement of the casing 10. The sensor 19 detects an amount of movement in the sub-scanning direction. For example, the sensor 19 may detect the amount of movement in the sub-scanning direction by detecting an amount of rotation of the roller 17 or the roller 18. The sensor 19 may be an acceleration sensor or the like.

The power button 13, the temperature switching button 14, the heating button 15, and the print button 16 are disposed side by side on the upper surface of the casing 10. The power button 13, the temperature switching button 14, the heating button 15, and the print button 16 may be provided anywhere in the casing 10 as long as the buttons are in a position where the user can press the buttons.

The power button 13 is a button for switching ON and OFF of the power. The mobile printer 1 switches ON and OFF of the power according to the state of the power button 13. For example, the mobile printer 1 may be turned ON in a state where the power button 13 is pressed in. The mobile printer 1 may switch ON and OFF of the power depending on the number of times the power button 13 is pressed. The mobile printer 1 may switch ON and OFF of the power according to the time during which the power button 13 is pressed.

The temperature switching button 14 is a button for designating a set temperature of the decolorizing surface in the decolorizing device 11. For example, in a state where the temperature switching button 14 is pressed in, the decolorizing surface of the decolorizing device 11 is set to be a first temperature. In a state where the temperature switching button 14 is not pressed in, the decolorizing surface of the decolorizing device 11 is set to a second temperature different from the first temperature.

The heating button 15 is a button for switching ON and OFF of heating to the decolorizing surface of the decolorizing device 11. For example, the decolorizing device 11 is controlled to heat the decolorizing surface while the heating button 15 is pressed. When the heating button 15 is not pressed, the decolorizing device 11 is controlled to turn OFF heating to the decolorizing surface. The heating button 15 may include a mechanism for holding the heating button 15 in a pressed state. By holding the heating button 15 in the pressed state, the decolorizing device 11 is kept in a continuous state of heating the decolorizing surface.

The print button 16 is a button for switching ON and OFF of image formation by the print head 12. For example, when the print button 16 is pressed, the print head 12 is controlled to print image data according to the movement of the casing 10. While the print button 16 is pressed, the print head 12 is controlled to form an image according to the movement of the casing 10. When the print button 16 is not pressed, the print head 12 may be controlled so as not to discharge ink from the print head 12.

Figure 3:
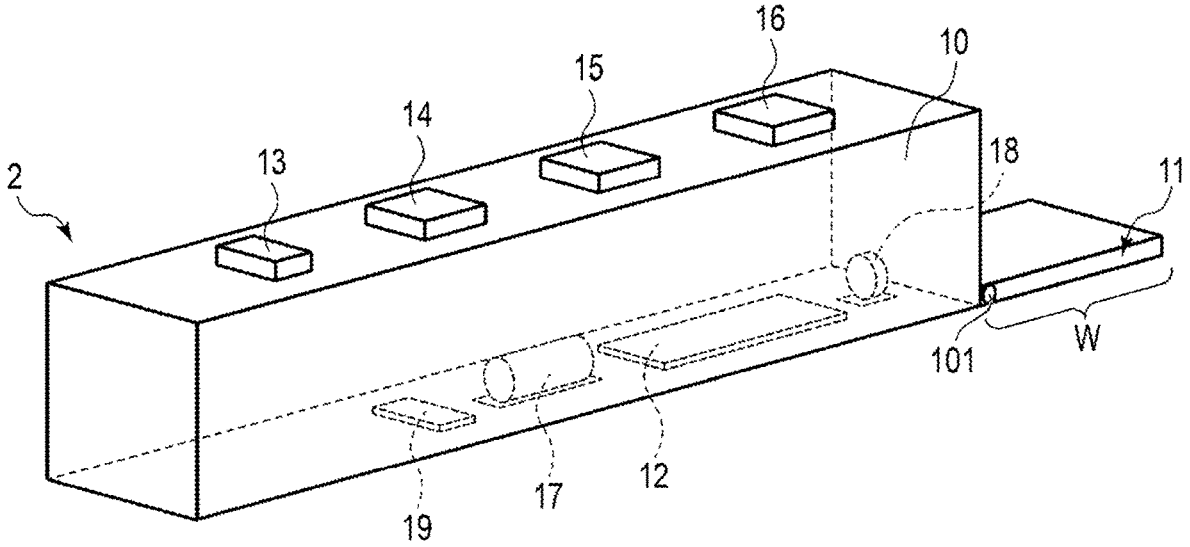
FIG. 3 is an external view illustrating a second configuration example of the mobile printer.
Figure 4:
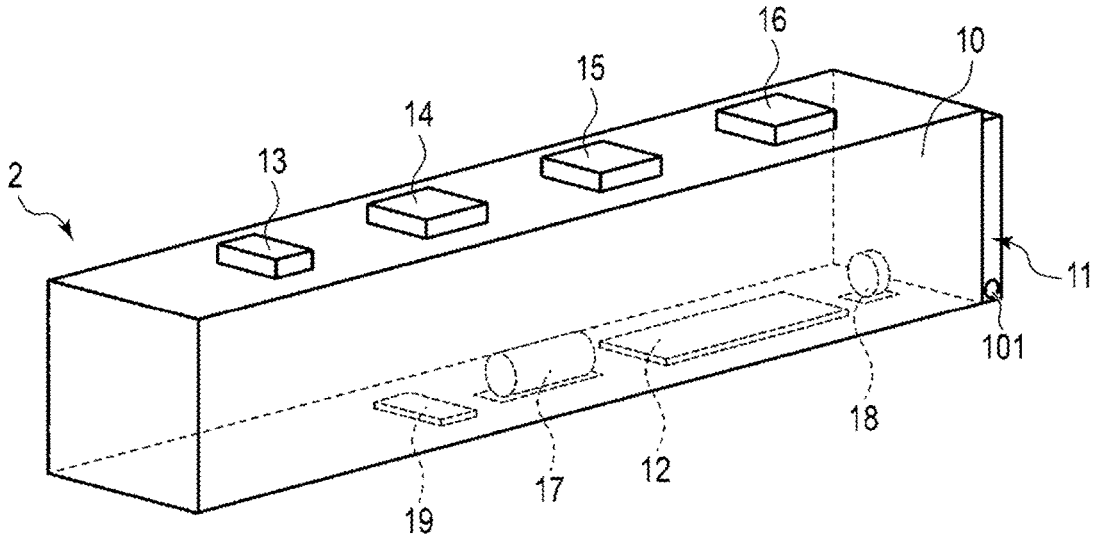
FIG. 4 is another external view illustrating the second configuration example of the mobile printer.

FIGS. 3 and 4 are external views illustrating a second configuration example of the mobile printer 1 according to at least one embodiment.

A mobile printer 2 illustrated in FIGS. 3 and 4 is a modification of the mobile printer 1 illustrated in FIGS. 1 and 2. The mobile printer 2 is different from the mobile printer 1 in an attaching position of the decolorizing device (translucent heater) 11 with respect to the casing 10. Since the mobile printer 2 has the same configuration as the mobile printer 1 except for the attaching position of the decolorizing device 11, the same reference numerals are given to the same parts and the detailed description thereof will be omitted.

The mobile printer 2 is configured so that a region to be printed by the print head 12 and a region to be decolorized by the decolorizing device 11 do not overlap when the casing 10 is moved in the sub-scanning direction. However, as illustrated in FIG. 3, also in the mobile printer 2, the decolorizing device 11 may be designed so that the decolorizing width W is the same as the print width of the print head 12.

In the example illustrated in FIGS. 3 and 4, in the mobile printer 2, the decolorizing device 11 is supported on the side surface of the print head 12 in the casing 10 in the main scanning direction through the support mechanism 101. In the mobile printer 2, the decolorizing device 11 rotates about the fulcrum of the support mechanism 101 with respect to the side surface of the print head 12 in the casing 10 in the main scanning direction.

FIG. 3 illustrates a state in which the decolorizing device 11 is in the decolorizing position of the mobile printer 2. At the decolorizing position illustrated in FIG. 3, the decolorizing device 11 is fixed at a position where the decolorizing surface is on the same surface as the bottom surface of the casing 10. In the mobile printer 2, when the bottom surface of the casing 10 is moved while being abutted on the recording medium, the decolorizing surface of the decolorizing device 11 also moves on the recording medium. Also in the mobile printer 2, the decolorizing device 11 is configured with a translucent member. For that reason, in the mobile printer 2, the user can directly visually recognize the position (decolorizing position) where the decolorizing surface of the decolorizing device 11 abuts on, similar to the mobile printer 1.

FIG. 4 illustrates a state in which the decolorizing device 11 is in the accommodating position of the mobile printer 2. The mobile printer 2 holds the decolorizing device 11 in the accommodating position illustrated in FIG. 4. When the decolorizing device 11 is accommodated in the accommodating position, the mobile printer 2 can reduce the bottom area (area of the bottom surface including the bottom surface of the casing 10 and the decolorizing surface of the decolorizing device 11), similar to the mobile printer 1. By holding the decolorizing device 11 in the accommodating position, the decolorizing device 11 can be prevented from becoming bulky, and the mobile printer 2 can be easily carried around. Similar to the mobile printer 1, the mobile printer 2 is configured so that power is not supplied to the decolorizing device 11 located at the accommodating position.

Next, the configuration of the decolorizing device 11 included in the mobile printer 1 or 2 according to at least one embodiment will be described.

Figure 5:
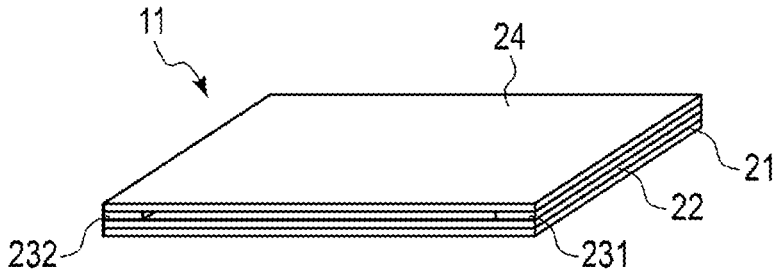
FIG. 5 is a diagram illustrating a configuration example of a decolorizing device mounted on the mobile printer.
Figure 6:
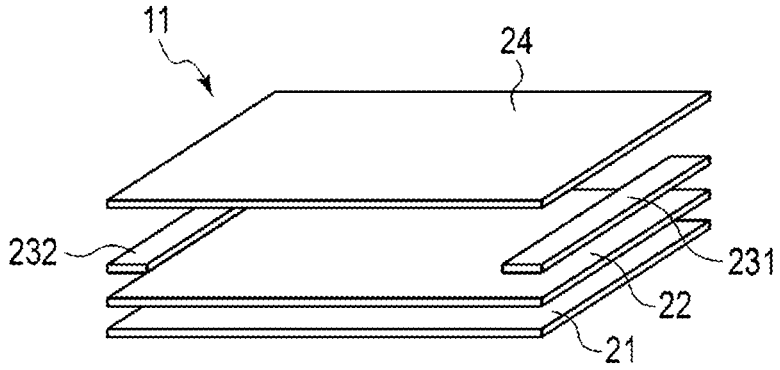
FIG. 6 is a diagram illustrating an example of parts configuring the decolorizing device mounted on the mobile printer.

FIG. 5 is a diagram illustrating a configuration example of the decolorizing device 11 included in the mobile printer 1 or 2 according to at least one embodiment. FIG. 6 is a diagram illustrating parts configuring the decolorizing device 11 illustrated in FIG. 5.

As illustrated in FIGS. 5 and 6, the decolorizing device 11 includes the translucent substrate 21, a translucent film 22, electrodes 23 (first electrode 231 and second electrode 232), and an insulating layer 24.

The translucent substrate 21 is a translucent substrate such as a glass substrate or a PET film. The translucent film 22 is a translucent film having conductivity such as an indium tin oxide (ITO) film. The translucent film 22 has electrical resistance (sheet resistance). For example, the translucent film 22 is formed on the translucent substrate 21 by vapor deposition.

The first electrode 231 and the second electrode 232 are connected to the translucent film 22. The translucent insulating layer 24 such as a glass cover is formed on the translucent film 22 to which the electrodes 23 are connected. The first electrode 231 and the second electrode 232 are connected to a heater drive circuit 35 (see FIG. 7), which will be described later. When a voltage is applied between the first electrode 231 and the second electrode 232, a current flows through the translucent film 22, and Joule heat is generated due to sheet resistance. The Joule heat generated in the translucent film 22 heats the translucent substrate 21. The heated translucent substrate 21 gives heat to an object in contact with the surface thereof (decolorizing surface).

Next, a configuration of a control system in the mobile printer 1 or 2 will be described.

Figure 7:
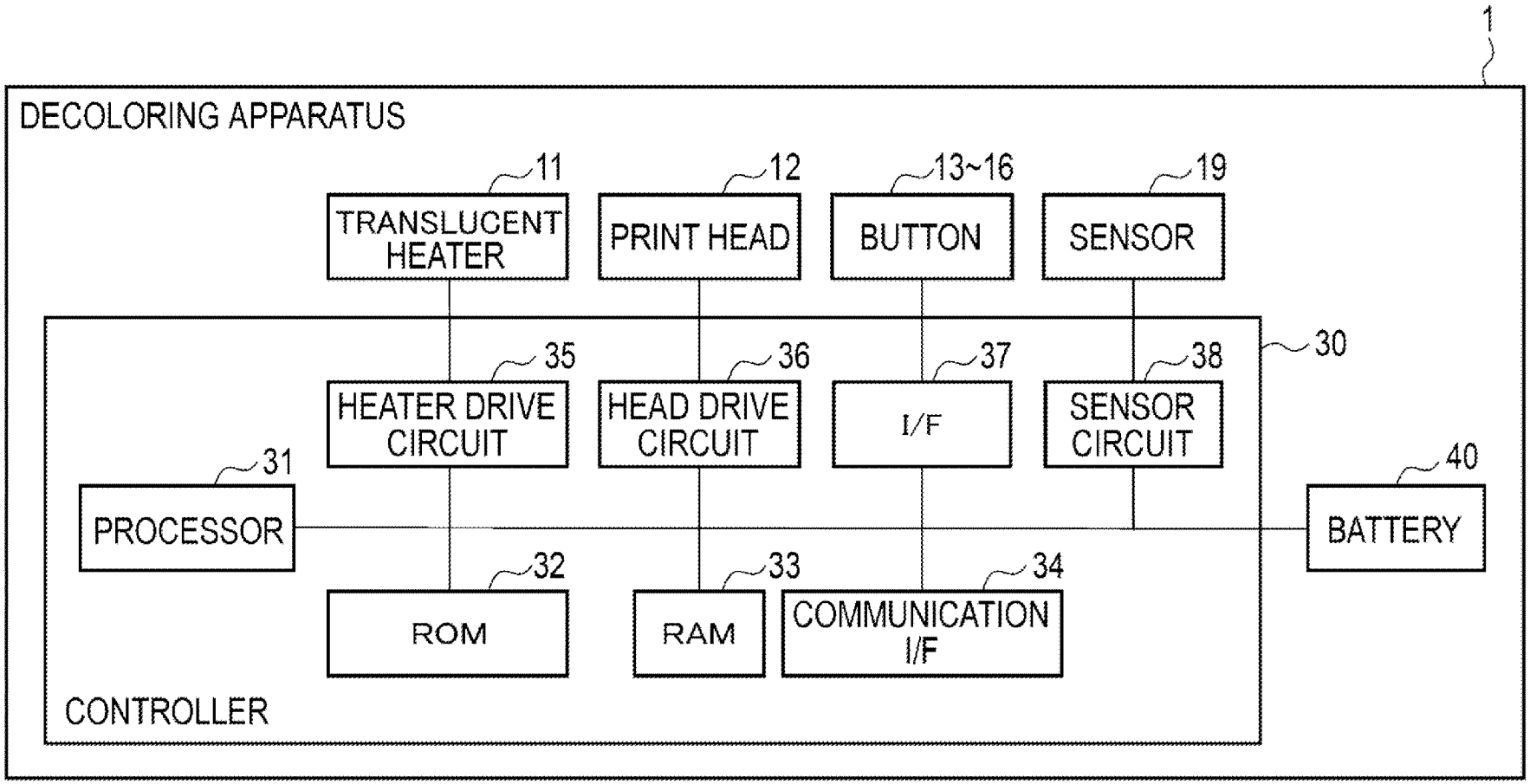
FIG. 7 is a block diagram illustrating a configuration example of a control system in the mobile printer.

FIG. 7 is a block diagram illustrating a configuration example of the control system in the mobile printer 1 or 2.

As illustrated in FIG. 7, the mobile printer 1 or 2 includes the controller 30 and the battery 40. The controller 30 and the battery 40 are provided in the casing 10. The controller 30 is connected to the decolorizing device 11, the print head 12, various buttons 13 to 16, the sensor 19, and the battery 40.

The controller 30 controls the driving of the mobile printer 1 or 2 according to the state of each of the buttons 13 to 16. The battery 40 provides energy for heating the heat source of the decolorizing device 11. The battery 40 is a rechargeable secondary battery built in the casing 10. The casing 10 may be provided with a battery box to and from which a battery as the battery 40 can be attached and detached.

The controller 30 includes a processor 31, a ROM 32, a RAM 33, a communication interface (I/F) 34, the heater drive circuit 35, a head drive circuit 36, an interface 37, and a sensor circuit 38. Power is supplied to the controller 30 from the battery 40. The mobile printer 1 or 2 may be provided with an interface for supplying power for charging to the battery 40.

The processor 31 controls each unit and the like. The processor 31 is, for example, a CPU. The processor 31 executes a program for controlling each part. The processor 31 is connected to the ROM 32, the RAM 33, the communication interface (I/F) 34, the heater drive circuit 35, the head drive circuit 36, the interface 37, and the sensor circuit 38 via a bus. The ROM 32 is a non-volatile memory for storing a program. The RAM 21 is a working memory that temporarily stores data.

The communication interface 34 is an interface for communicating with an external device. For example, the communication interface 34 acquires image data of an image formed on the recording medium by the print head 12. The communication interface 34 may acquire a control signal from the external device.

The heater drive circuit 35 includes a circuit that drives the decolorizing device 11. The heater drive circuit 35 controls the driving of the decolorizing device according to a control signal from the processor 31. For example, the heater drive circuit 35 applies a voltage of a value designated by the processor 31 according to the set temperature between the electrodes 231 and 232 (translucent film 22).

The head drive circuit 36 includes a circuit that drives the print head 12. The head drive circuit 36 controls driving of the print head 12 according to the control signal from the processor 31. For example, the head drive circuit 36 drives the print head 12 according to the control signal from the processor 31.

The interface 37 connects the buttons 13 to 16. The processor 31 acquires a signal indicating the state of each of the buttons 13 to 16 via the interface 37.

The sensor circuit 38 acquires a detection signal of the sensor 19. For example, the sensor circuit 38 supplies a signal indicating the amount of movement in the sub-scanning direction detected by the sensor 19 to the processor 31.

Next, a relationship between a voltage to be applied to the translucent film 22 of the decolorizing device 11 and a temperature occurring on the surface of the translucent substrate 21 of the decolorizing device 11 will be described.

Figure 8:
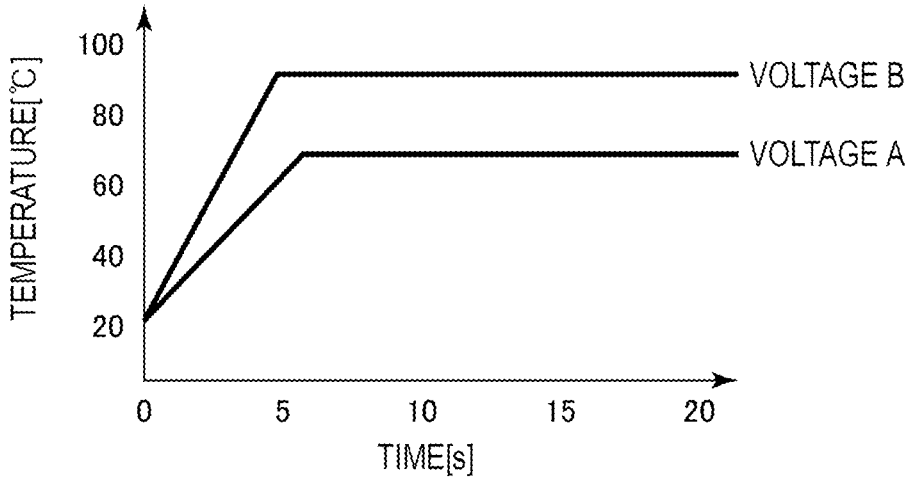
FIG. 8 is a graph illustrating an example of a temperature change when a voltage is applied to the decolorizing device mounted on the mobile printer.

FIG. 8 is a diagram illustrating the relationship between the temperature and the time, which occurs when two types of voltages are applied to the translucent film 22 (electrodes 231 and 232) of the decolorizing device 11.

FIG. 8 illustrates a temperature change when a voltage A is applied to the translucent film 22 of the decolorizing device 11 and a temperature change when a voltage B larger than the voltage A is applied to the translucent film 22. As illustrated in FIG. 8, when a voltage is applied to the translucent film 22 of the decolorizing device 11, the temperature of the translucent substrate 21 rises. The temperature of the translucent substrate 21 reaches a predetermined temperature several seconds after the voltage is applied. In the example illustrated in FIG. 8, when the voltage A is applied, the temperature of the translucent substrate 21 becomes about 70° C. after six to seven seconds. When the voltage B is applied, the temperature of the translucent substrate 21 becomes about 90° C. after five to six seconds.

In at least one embodiment, it is assumed that the mobile printer 1 or 2 can set two kinds of temperatures as the temperature of the translucent substrate 21. The processor 31 of the controller 30 sets the temperature of the translucent substrate 21 according to the state of the temperature switching button 14. As illustrated in FIG. 8, the temperature of the translucent substrate 21 is determined by a voltage value to be applied to the translucent film 22. For that reason, the processor 31 of the controller 30 sets the voltage value to be applied to the decolorizing device 11 by the heater drive circuit 35 according to the state of the temperature switching button 14.

For example, the temperature set by the temperature switching button 14 is switched according to the object to be decolorized. Some thermochromic colorants have different decolorizing temperatures for decolorizing (decolorizing). As a specific example, it is assumed that a first colorant is decolorized at a temperature higher than a first decolorizing temperature and a second colorant is decolorized at a second decolorizing temperature higher than the first decolorizing temperature. In this case, at a temperature equal to or higher than the first decolorizing temperature and lower than the second decolorizing temperature, the second colorant is not decolorized but the first colorant is decolorized. At a temperature equal to and higher than the second decolorizing temperature, both the second colorant and the first colorant are decolorized. The user can designate either a setting for decolorizing the first colorant without decolorizing the second colorant or a setting for decolorizing both the first colorant and the second colorant with the temperature switching button 14.

Actually, the thermochromic colorant on the recording medium is decolorized by heat applied to the recording medium from the surface of the translucent substrate 21. For that reason, the user may switch the setting of temperature with the temperature switching button 14 according to the situation to be used. For example, when the user wants to quickly move the decolorizing device 11 to decolorize the thermochromic colorant on the recording medium, the user may set the temperature higher with the temperature switching button 14. When the user does not want to give the recording medium as high a temperature as possible, the user may set the temperature lower with the temperature switching button 14 to slowly move the decolorizing device 11.

Next, the operations of the mobile printers 1 and 2 according to at least one embodiment will be described.

Here, it is assumed that the mobile printers 1 and 2 have a decolorizing mode and a decolorizing and printing mode as operation modes. The decolorizing mode is an operation mode in which decolorizing processing is performed by the decolorizing device 11 without printing by the print head 12. The decolorizing and printing mode is an operation mode in which the print head 12 prints on the region which has been decolorized by the decolorizing device 11.

First, the operation in the decolorizing mode of the mobile printers 1 and 2 will be described.

Figure 9:
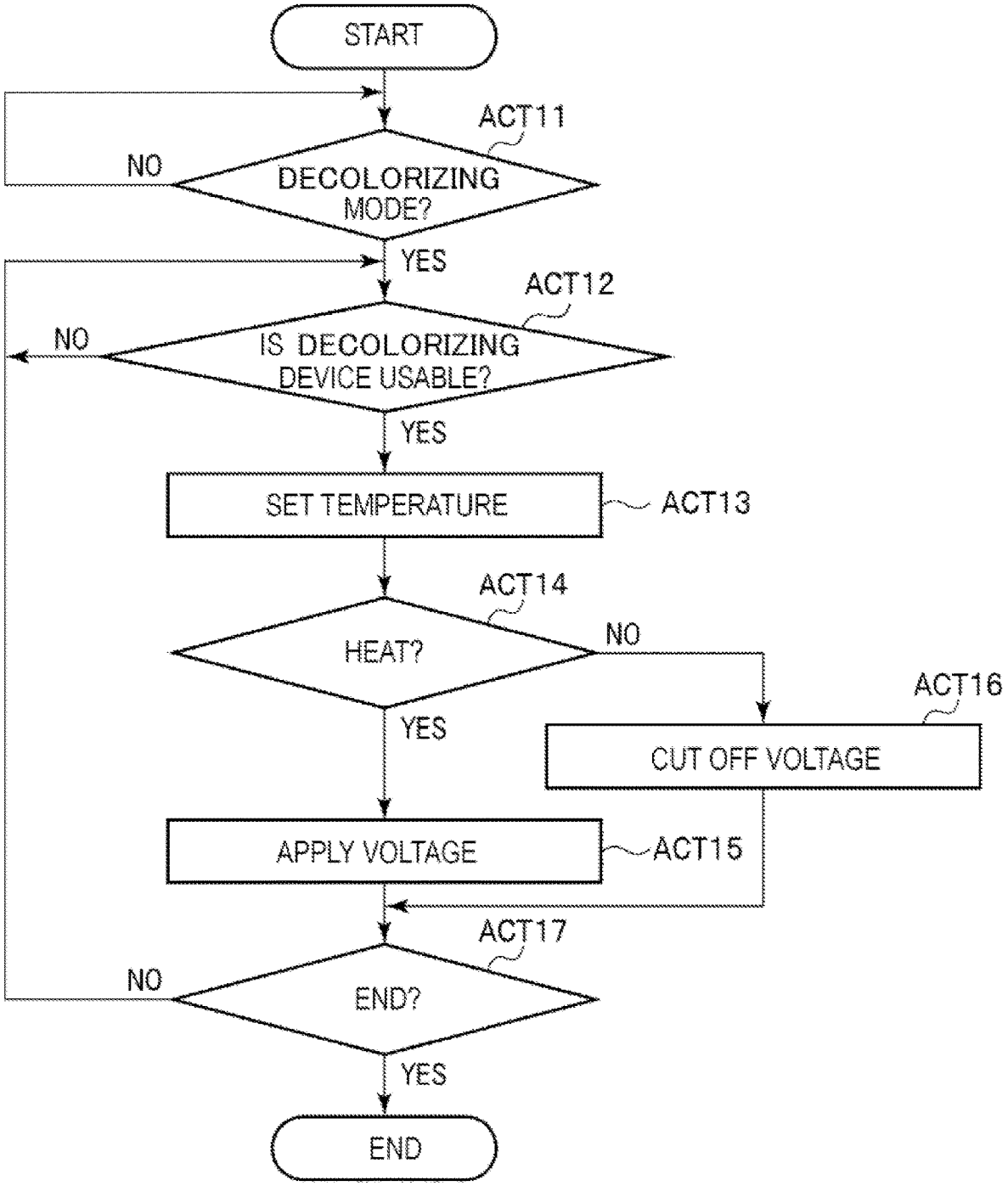
FIG. 9 is a flowchart for illustrating an operation example of the mobile printer.

FIG. 9 is a flowchart for describing an operation example in the decolorizing mode of the mobile printers 1 and 2.

When it is determined that the operation mode is the decolorizing mode (YES in ACT 11), the processor 31 of the controller 30 determines whether the decolorizing device 11 is in a usable state (ACT 12). For example, when the decolorizing device 11 is in the decolorizing position as illustrated in FIG. 1 or 3, the processor 31 determines that the decolorizing device 11 is in the usable state. When the decolorizing device 11 is in the accommodating position as illustrated in FIG. 2 or 4, the processor 31 determines that the decolorizing device 11 is in an unusable state. The processor 31 may determine whether or not the decolorizing device 11 is in the usable state depending on whether or not the decolorizing device 11 is electrically connected to the controller 30.

When it is determined that the decolorizing device 11 is in the unusable state (NO in ACT 12), the processor 31 waits for the decolorizing device 11 to become the usable state. The mobile printer 1 may be provided with an indicator such as an LED indicating whether the decolorizing device 11 is in the usable state or the unusable state. When it is determined that the decolorizing device 11 is in the unusable state, the processor 31 may cause the indicator to indicate that the decolorizing device 11 is in the unusable state.

When it is determined that the decolorizing device 11 is in the usable state (YES in ACT 12), the processor 31 sets the temperature of the translucent substrate 21 having the decolorizing surface according to the state of the temperature switching button 14 (ACT 13). For example, the processor 31 detects the state of the temperature switching button 14. When the temperature switching button 14 is in the state of designating the first temperature, the processor 31 sets a voltage value corresponding to the first temperature in the heater drive circuit 35 as a voltage value to be applied to the decolorizing device 11. When the temperature switching button 14 is in the state of designating the second temperature, the processor 31 sets a voltage value corresponding to the second temperature in the heater drive circuit 35 as a voltage value to be applied to the decolorizing device 11.

After setting the temperature according to the state of the temperature switching button 14, the processor 31 determines whether or not to heat the translucent substrate 21 of the decolorizing device 11 (ACT 13). For example, the processor 31 determines to heat the translucent substrate 21 if the heating button 15 is pressed, and determines not to heat the translucent substrate 21 if the heating button 15 is not pressed. In this case, the processor 31 detects the state of the heating button 15 and determines whether or not to heat the translucent substrate 21 according to the state of the heating button 15.

When it is determined to heat the translucent substrate 21 (YES in ACT 14), the processor 31 applies a voltage of a value set according to the state of the temperature switching button 14 to the electrodes 231 and 232 (translucent film 22) of the decolorizing device 11 (ACT 15). For example, the processor 31 causes a voltage to be applied to the electrodes 231 and 232 from the heater drive circuit 35 in which the voltage value to be applied is set according to the state of the temperature switching button 14.

When it is determined not to heat the translucent substrate 21 (NO in ACT 14), the processor 31 cuts off the voltage applied to the electrodes 231 and 232 of the decolorizing device 11 (ACT 16). For example, the processor 31 stops the application of the voltage from the heater drive circuit 35 to the electrodes 231 and 232 of the decolorizing device 11.

While the operation mode is the decolorizing mode (NO in ACT 17), the processor 31 repeatedly executes the processing of ACTs 12 to 16. When the power OFF is instructed through the power button 13 or when a change to an operation mode other than the decolorizing mode is instructed, the processor 31 determines to terminate the decolorizing mode. When it is determined to terminate the decolorizing mode (YES in ACT 17), the processor 31 ends the operation in the decolorizing mode.

As described above, the mobile printer according to at least one embodiment has the decolorizing mode for decolorizing the thermochromic colorant on the recording medium using the decolorizing device with respect to the recording medium. Since the decolorizing device is translucent, the user can move the casing while checking the place to be decolorized, and decolorizing the desired region can be surely performed.

Next, the operation in the decolorizing and printing mode of the mobile printer 1 will be described.

Figure 10:
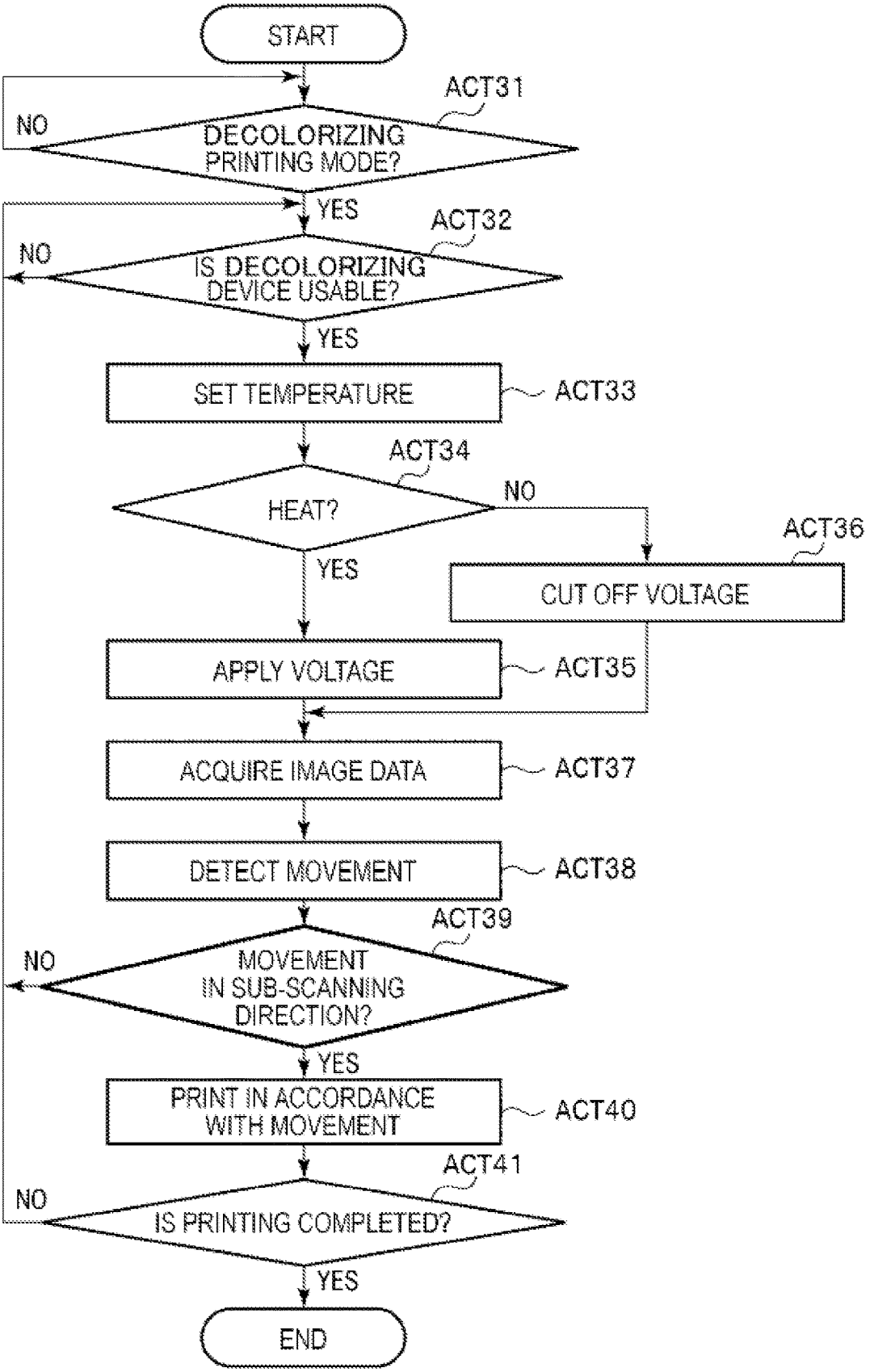
FIG. 10 is a flowchart for illustrating another operation example of the mobile printer.

FIG. 10 is a flowchart for describing an operation example in the decolorizing and printing mode in the mobile printer 1.

When it is determined that the operation mode is the decolorizing and printing mode (YES in ACT 31), the processor 31 of the controller 30 determines whether the decolorizing device 11 is in a usable state (ACT 32). For example, when the decolorizing device 11 is in the decolorizing position as illustrated in FIG. 1, the processor 31 determines that the decolorizing device 11 is in the usable state. When the decolorizing device 11 is in the accommodating position as illustrated in FIG. 2, the processor 31 determines that the decolorizing device 11 is in an unusable state. The processor 31 may determine whether or not the decolorizing device 11 is in the usable state depending on whether or not the decolorizing device 11 is electrically connected to the controller 30.

When it is determined that the decolorizing device 11 is in the unusable state (NO in ACT 32), the processor 31 waits for the decolorizing device 11 to become the usable state.

When it is determined that the decolorizing device 11 is in the usable state (YES in ACT 32), the processor 31 sets the temperature of the translucent substrate 21 having the decolorizing surface according to the state of the temperature switching button 14 (ACT 33). For example, the processor 31 detects the state of the temperature switching button 14. When the temperature switching button 14 is in the state of designating the first temperature, the processor 31 sets a voltage value corresponding to the first temperature in the heater drive circuit 35 as a voltage value to be applied to the decolorizing device 11. When the temperature switching button 14 is in the state of designating the second temperature, the processor 31 sets a voltage value corresponding to the second temperature in the heater drive circuit 35 as a voltage value to be applied to the decolorizing device 11.

After setting the temperature according to the state of the temperature switching button 14, the processor 31 determines whether or not to heat the translucent substrate 21 of the decolorizing device 11 (ACT 33). For example, the processor 31 detects the state of the heating button 15 and determines whether or not to heat the translucent substrate 21 according to the state of the heating button 15.

When it is determined to heat the translucent substrate 21 (YES in ACT 34), the processor 31 applies a voltage of a value set according to the state of the temperature switching button 14 to the electrodes 231 and 232 (translucent film 22) of the decolorizing device 11 (ACT 35). The processor 31 applies the voltage of the set voltage value to the translucent film 22 of the decolorizing device 11 using the heater drive circuit 35.

When it is determined not to heat the translucent substrate 21 (NO in ACT 34), the processor 31 cuts off the voltage to be applied to the electrodes 231 and 232 of the decolorizing device 11 (ACT 36). The processor 31 stops the application of the voltage from the heater drive circuit 35 to the translucent film 22 of the decolorizing device 11.

In the decolorizing and printing mode, the processor 31 acquires image data to be printed on the recording medium using the print head 12 through the communication interface 34 (ACT 37). The processor 31 stores the image data acquired through the communication interface 34 in a memory such as the RAM 33. In the decolorizing and printing mode, the processor 31 detects the movement of the casing 10 based on the detection signal of the sensor 19 (ACT 38). For example, the processor 31 acquires the detection signal of the sensor 19 by the sensor circuit 38. The processor 31 detects the amount of movement of the casing 10 in the sub-scanning direction with respect to the main scanning direction of the print head 12, based on the detection signal of the sensor 19 acquired by the sensor circuit 38.

The processor 31 determines whether or not the casing 10 is moved in the sub-scanning direction. When the movement of the casing 10 in the sub-scanning direction is detected (YES in ACT 39), the processor 31 prints the image data on the recording medium using the print head 12. The processor 31 drives the print head 12 by the head drive circuit 36 according to the detected movement amount in the sub-scanning direction and the image data. The head drive circuit 36 causes ink containing a thermochromic colorant to be discharged from each pixel of the print head 12 according to the control from the processor 31.

Here, in the mobile printer 1 illustrated in FIG. 1, the decolorizing device 11 is disposed upstream of the print head 12 in the sub-scanning direction. The mobile printer 1 is designed so that the width to be decolorized by the decolorizing device 11 and the width to be printed by the print head 12 are the same in the main scanning direction. In the mobile printer 1, when the casing 10 moves in the sub-scanning direction, the print head 12 prints each pixel based on the image data in the region which has been decolorized by the decolorizing device 11.

The processor 31 monitors whether or not the printing of the image based on the image data acquired via the communication interface 34 was completed (ACT 41). When it is determined that the printing of the image based on the acquired image data is not completed (NO in ACT 41), the processor 31 repeatedly executes the processing of ACTs 32 to 40. When it is determined that the printing of the image based on the image data was completed (YES in ACT 41), the processor 31 ends the printing of the image in the decolorizing and printing mode.

As described above, the mobile printer according to at least one embodiment has the decolorizing and printing mode in which the decolorizing device prints an image on the recording medium with the print head while decolorizing the thermochromic colorant. Since the decolorizing device is translucent, the user can move the casing while checking the place to be decolorized, and decolorizing and printing to a desired region can be performed in one operation.

The mobile printer according to at least one embodiment may have a configuration in which the decolorizing device is disposed upstream of the print head in the sub-scanning direction. In the mobile printer having such a configuration, by moving the casing in the sub-scanning direction by the user, the image can be printed by the print head on the region after having been decolorized by the decolorizing device.

The mobile printer according to at least one embodiment may be configured so that the decolorizing width of the decolorizing device 11 and the print width of the print head 12 in the main scanning direction are the same. In the mobile printer having such a configuration, the region to be decolorized by the decolorizing device and the region to be printed by the print head can be the same region when the casing moves in the sub-scanning direction.

While certain embodiments have been described, these embodiments have been presented by way of example only, and are not intended to limit the scope of the inventions. Indeed, the novel embodiments described herein may be embodied in a variety of other forms. Furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A mobile printer comprising:

a casing configured to receive a power supply;

a sensor configured to detect movement of the casing;

a print head configured to discharge ink containing a thermochromic colorant; an interface configured to acquire image data;

a controller configured to cause the ink to be discharged from the print head based on the image data acquired by the interface and the movement of the casing detected by the sensor; and a decolorizing device configured to couple to the casing and comprising a translucent film configured to generate heat when a voltage is applied; and a translucent substrate configured to be heated to a temperature at which the thermochromic colorant is decolorized by the heat generated by the translucent film.

2. The printer of claim 1, further comprising:

a support mechanism configured to hold the decolorizing device to the casing so as to be movable between an accommodating position and a discoloration position.

3. The printer of claim 2, wherein the controller is configured to determine the decolorizing device is in a usable state when the decolorizing device is in the decolorizing position.

4. The printer of claim 2, wherein the controller is configured to determine the decolorizing device is in an unusable state when the decolorizing device is in the accommodating position.

5. The printer of claim 1, further comprising:

a temperature switching button configured to designate temperature.

6. The printer of claim 5, wherein the controller controls a value of the voltage to be applied to the translucent film of the decolorizing device according to the temperature designated by the temperature switching button.

7. The printer of claim 1, further comprising:

a roller configured to regulate a moving direction of the casing in a sub-scanning direction with respect to a main scanning direction of the print head.

8. The printer of claim 7, wherein the controller applies the voltage to the translucent film of the decolorizing device located upstream of the print head in the sub-scanning direction.

9. The printer of claim 8, wherein the decolorizing device is configured so that the width of the translucent substrate in the main scanning direction when coupled to the casing is the same as the print width of the print head in the main scanning direction.

10. The printer of claim 1, wherein the controller is configured to cause a voltage A to be applied to the translucent film to increase the temperature of the translucent film and the translucent substrate, and to cause a voltage B larger than the voltage A to be applied to the translucent film to increase the temperature of the translucent film and the translucent substrate.

11. The printer of claim 10, wherein the controller is configured to cause the voltage A to be applied to cause the temperature of the translucent substrate to reach 70° C. after six to seven seconds.

12. The printer of claim 11, wherein the controller is configured to cause the voltage B to be applied to cause the temperature of the translucent substrate to reach 90° C. after five to six seconds.

13. A method of operating a mobile printer, the method comprising:

detecting movement, via a sensor, of a casing;

acquiring image data, via an interface;

discharging ink, via a print head, based on the image data acquired by the interface and the movement of the casing detected by the sensor;

applying a voltage to generate heat at a translucent film when the voltage is applied; and heating a translucent substrate to a temperature by the heat generated by the translucent film to decolorize a thermochromic colorant of the ink.

14. The method of claim 13, further comprising:

holding the decolorizing device to the casing, via a support mechanism, so as to be movable between an accommodating position and a discoloration position.

15. The method of claim 14, further comprising determining the decolorizing device is in a usable state when the decolorizing device is in the decolorizing position and in an unusable state when the decolorizing device is in the accommodating position.

16. The method of claim 13, further comprising:

designating a temperature, via a temperature switching button; and controlling a value of the voltage to be applied to the translucent film of the decolorizing device according to the temperature designated by the temperature switching button.

17. The method of claim 13, further comprising:

regulating a moving direction of the casing, via a roller, in a sub-scanning direction with respect to a main scanning direction of the print head; and applying the voltage to the translucent film of the decolorizing device located upstream of the print head in the sub-scanning direction.

18. The method of claim 17, wherein the decolorizing device is configured so that the width of the translucent substrate in the main scanning direction when coupled to the casing is the same as the print width of the print head in the main scanning direction.

19. The method of claim 13, further comprising applying a voltage A to the translucent film to increase the temperature of the translucent film and the translucent substrate, and applying a voltage B larger than the voltage A to the translucent film to increase the temperature of the translucent film and the translucent substrate.

20. The method of claim 19, further comprising applying the voltage A to cause the temperature of the translucent substrate to reach 70° C. after six to seven seconds, and applying the voltage B to cause the temperature of the translucent substrate to reach 90° C. after five to six seconds.

* * * * *